US009281144B2

(12) United States Patent
Ferree

(10) Patent No.: US 9,281,144 B2
(45) Date of Patent: Mar. 8, 2016

(54) CIRCUIT BREAKER CONTACT ASSEMBLY AND CAM LEVER

(75) Inventor: James Edward Ferree, Lawrenceville, GA (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 0 days.

(21) Appl. No.: 14/368,077

(22) PCT Filed: Feb. 9, 2012

(86) PCT No.: PCT/US2012/024437

§ 371 (c)(1),
(2), (4) Date: Jun. 23, 2014

(87) PCT Pub. No.: WO2013/119232

PCT Pub. Date: Aug. 15, 2013

(65) Prior Publication Data

US 2015/0041436 A1 Feb. 12, 2015

(51) Int. Cl.

| | |
|---|---|
| ***H01H 1/22*** | (2006.01) |
| ***H01H 33/18*** | (2006.01) |
| ***H01H 1/50*** | (2006.01) |
| ***H01H 77/10*** | (2006.01) |
| ***H01H 33/02*** | (2006.01) |

(52) U.S. Cl.

CPC ..... *H01H 33/18* (2013.01); *H01H 1/226* (2013.01); *H01H 1/502* (2013.01); *H01H 33/02* (2013.01); *H01H 77/102* (2013.01)

(58) Field of Classification Search

CPC ... H01H 1/2058; H01H 1/255; H01H 77/102; H01H 77/104; H01H 3/3015; H01H 3/42

USPC ..... 200/400, 244; 335/16, 192, 165, 171, 335/189; 218/32

See application file for complete search history.

(56) References Cited

U.S. PATENT DOCUMENTS

| | | | | |
|---|---|---|---|---|
| 4,645,891 A * | 2/1987 | Changle | ..... | H01H 77/104 200/244 |
| 6,977,568 B1 | 12/2005 | Chien | | |
| 7,646,269 B2 * | 1/2010 | Weister | ..... | H01H 77/107 218/22 |

FOREIGN PATENT DOCUMENTS

| | | |
|---|---|---|
| EP | 0543496 A1 | 5/1993 |
| EP | 0717174 A1 | 6/1996 |
| EP | 0827174 A1 | 3/1998 |

OTHER PUBLICATIONS

PCT Search Report mailed Nov. 19, 2012 corresponding to PCT International Application No. PCT/US2012/024437 filed Feb. 9, 2012 (11 pages).

* cited by examiner

*Primary Examiner* — Vanessa Girardi

(57) ABSTRACT

A contact apparatus of a circuit breaker is disclosed. The contact apparatus has an outer carrier, an inner carrier, one or more contact fingers pivotally mounted to the inner carrier, a cam lever pivotally mounted to the outer carrier, and a cam and cam profile formed on respective ones of the cam lever and inner carrier. Circuit breakers and electrical contact assemblies having the contact apparatus, and methods of operating the contact apparatus and electrical contact assemblies are disclosed, as are other aspects.

18 Claims, 11 Drawing Sheets

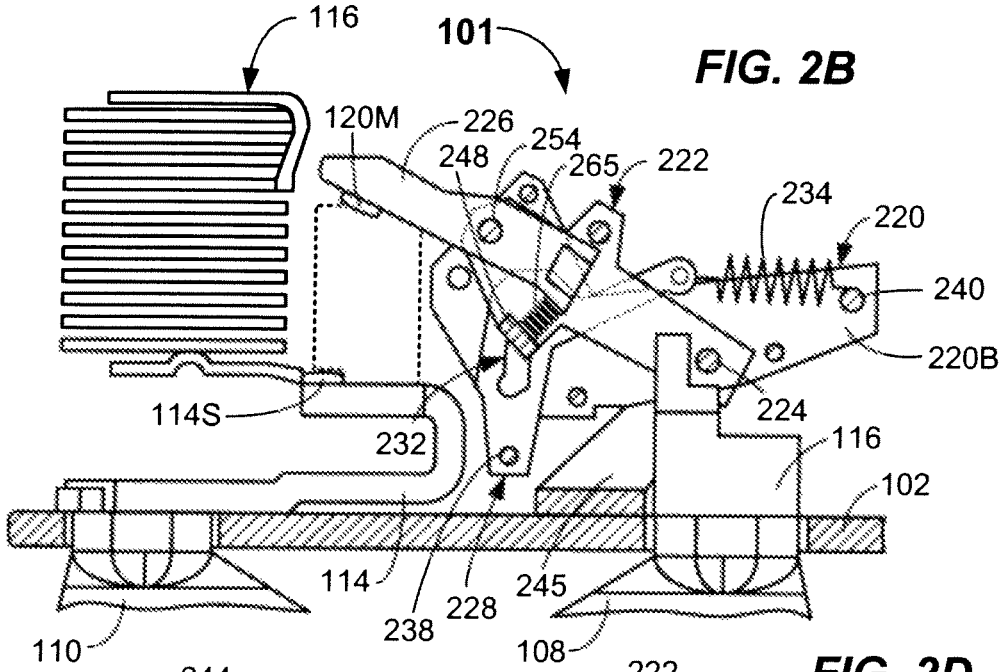
FIG. 2B
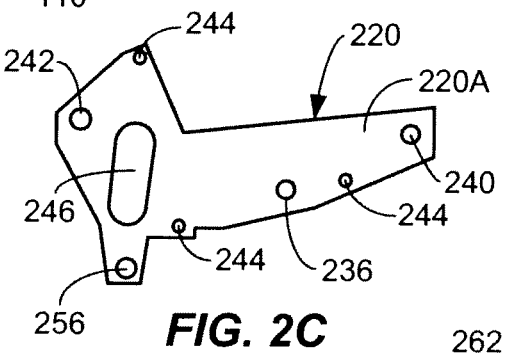
FIG. 2C
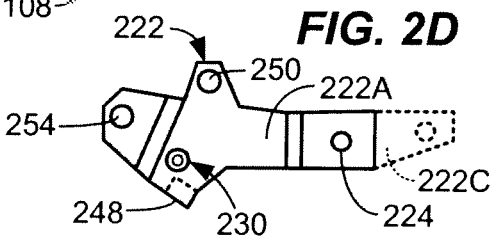
FIG. 2D
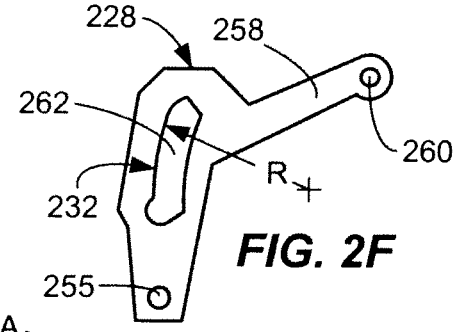
FIG. 2F
FIG. 2E
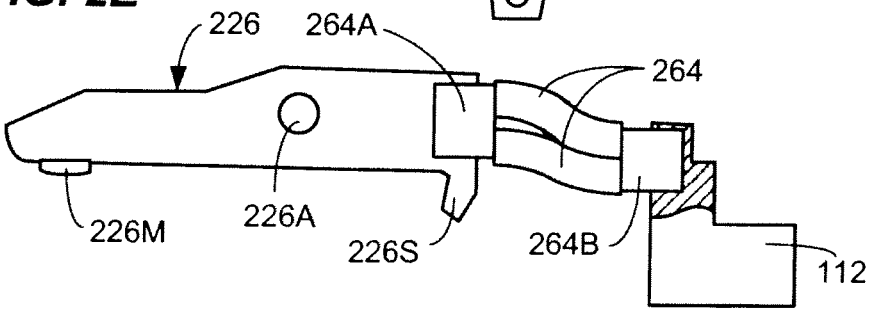

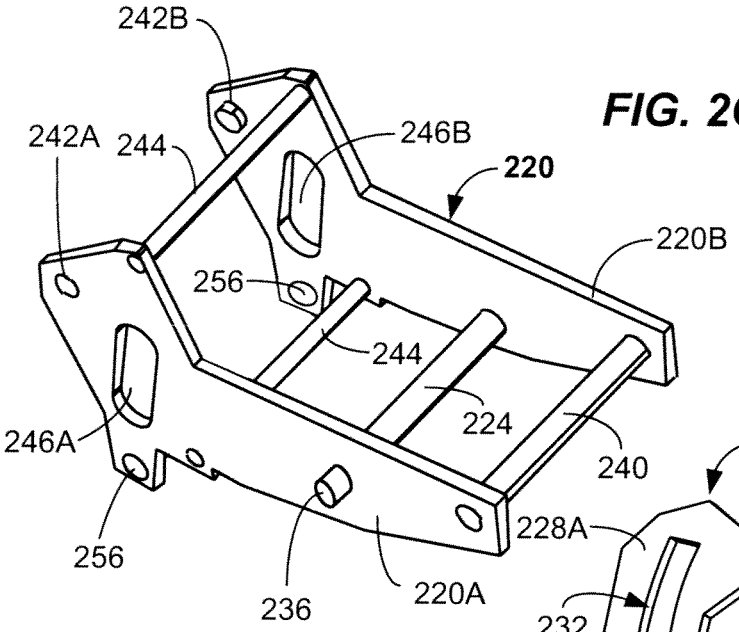
FIG. 2G
FIG. 2I
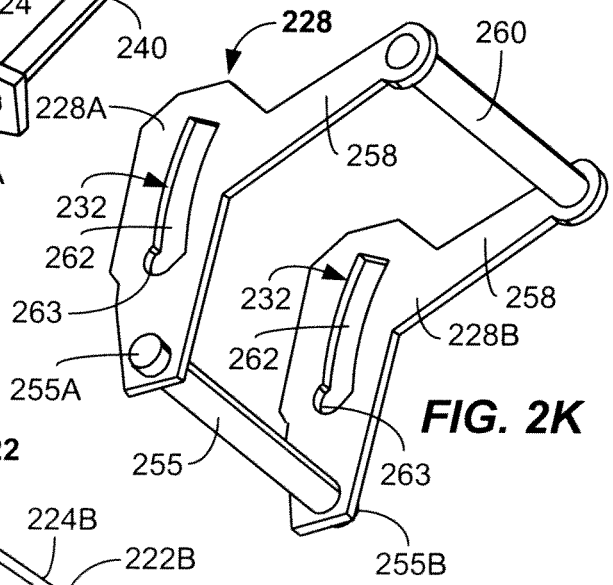
FIG. 2K
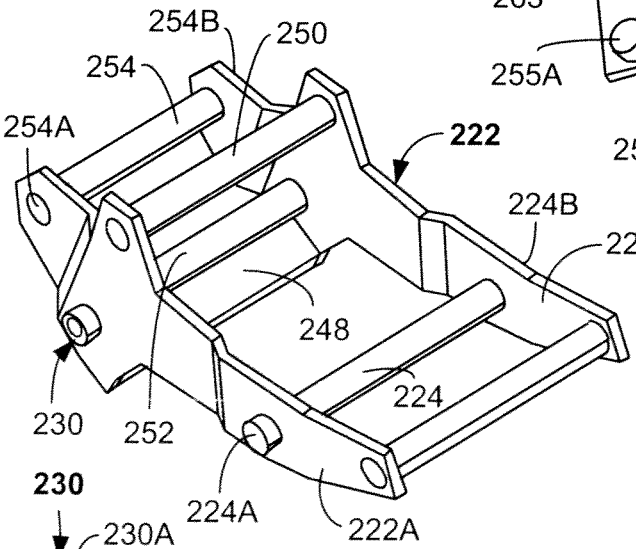
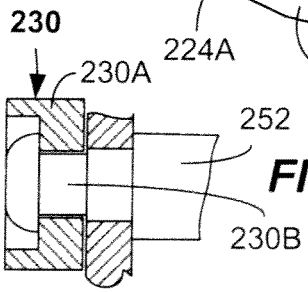
FIG. 2J
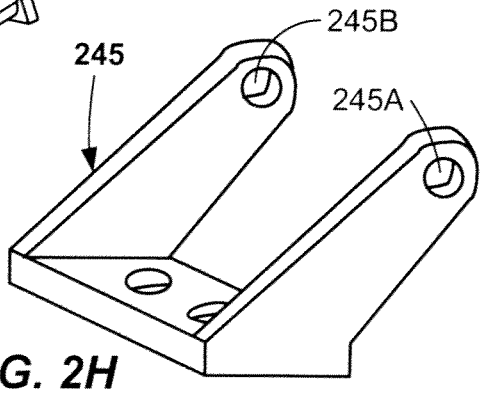
FIG. 2H

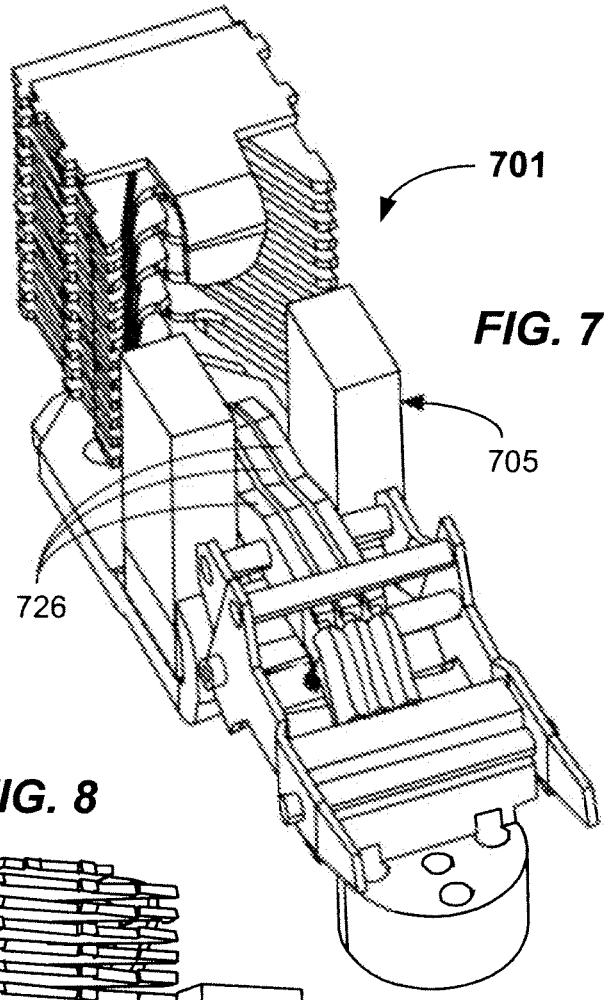
FIG. 7
FIG. 8
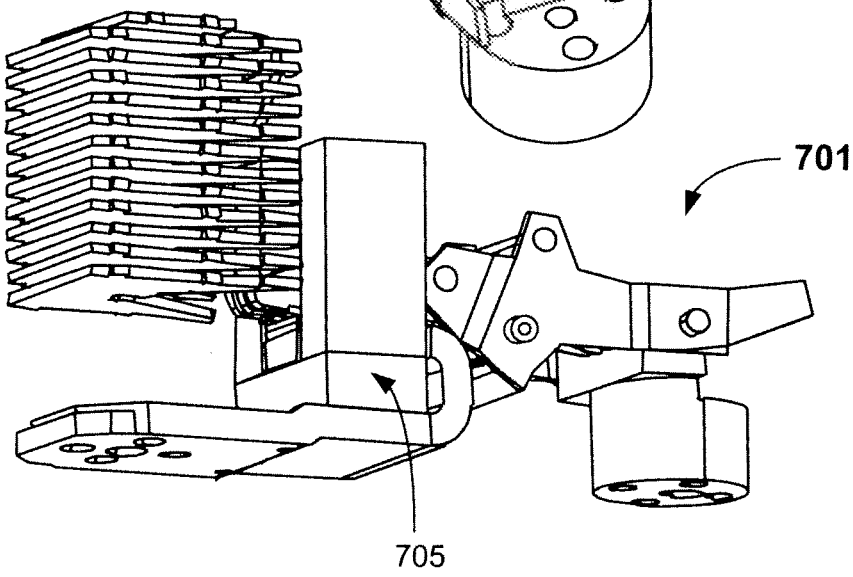

CIRCUIT BREAKER CONTACT ASSEMBLY AND CAM LEVER

FIELD

The present invention relates generally to circuit breakers, and more particularly to electrical contact mechanisms adapted to be used in circuit breakers.

BACKGROUND

Some low voltage circuit breakers can include electrical contact assemblies having one or more contact fingers per phase wherein the contact fingers are intended to blow apart due to magnetic repulsion under very high short circuit conditions. Generally, one or more springs bias the moveable contact fingers to a closed configuration such that intimate contact is provided between stationary and moveable electrical contacts. Some circuit breakers may include multiple contact assemblies arranged in a side-by-side configuration. For example, a single electrical phase may be directed and coupled to individual side-by-side electrical contact assemblies. Three- or four-phase circuit breaker assemblies are commonplace. In order to create sufficient contact force in certain circuit breakers, the contact springs coupled to the contact fingers may need to be made quite large. This, of course, may require a large space envelope, which may be unavailable or cause design compromises.

Thus, improved electrical contact apparatus adapted to use in such electrical contact assemblies are desired.

SUMMARY

In a first embodiment, an electrical contact apparatus is provided. The electrical contact apparatus includes an outer carrier, an inner carrier moveable relative to the outer carrier about an inner carrier pivot, one or more contact fingers pivotally mounted to the inner carrier, a cam lever pivotally mounted to the outer carrier, and a cam and cam profile formed on respective ones of the cam lever and inner carrier, the cam being adapted to follow the cam profile.

In another apparatus embodiment, a contact apparatus is provided. The contact apparatus includes an outer carrier having a first leg and a second leg spaced from the first leg, an outer carrier pivot, a cam lever pivot, and a cam spring mount, an inner carrier having a first side and a second side spaced from the first side, a contact spring support extending between the first and second side, and cams mounted to each of the first side and the second side, the inner carrier being adapted to pivot about an inner carrier pivot relative to the outer carrier wherein the inner carrier pivot and the outer carrier pivot are co-axial, one or more contact fingers pivotally mounted to a finger pivot pin extending between the first side and second side of the inner carrier, a contact spring biasing each contact finger relative to the contact spring support, a cam lever having a first lever side, and a second lever side, and a cam profile on each of the first cam side and the second cam side that are adapted to be engaged by the cams, the cam lever adapted to pivot relative to the outer carrier on the cam lever pivot, and a cam spring coupled between the cam lever and the cam spring mount.

In another embodiment, an electrical contact assembly is provided. The electrical contact assembly includes a contact apparatus having an outer carrier, an inner carrier having one or more contact fingers adapted to rotate relative to the inner carrier, each of the one or more contact fingers being spring biased relative to the inner carrier, the inner carrier being pivotable relative to the outer carrier, a cam lever pivotable relative to the outer carrier, a cam and a cam profile adapted to be engaged with the cam on respective ones of the cam lever and inner carrier; and an operating mechanism coupled to the outer carrier and adapted to open and/or close the contact apparatus.

In yet another embodiment, a circuit breaker is provided. The circuit breaker includes a circuit breaker housing; and an electrical contact assembly mounted in the circuit breaker housing, the electrical contact assembly including a contact apparatus having an outer carrier, an inner carrier having one or more contact fingers adapted to rotate relative to the inner carrier, each of the one or more contact fingers being spring biased relative to the inner carrier, the inner carrier being pivotable relative to the outer carrier, a cam lever pivotable relative to the outer carrier, and a cam and a cam profile adapted to be engaged with the cam on respective ones of the cam lever and inner carrier; and an operating mechanism coupled to the outer carrier and adapted to open and/or close the contact apparatus.

In a method embodiment, a method of operating an electrical contact apparatus is provided. The method includes providing a contact apparatus having an outer carrier, an inner carrier pivotable relative to the outer carrier and one or more contact fingers pivotable on the inner carrier, each of the one or more contact fingers being spring biased relative to the inner carrier, a cam lever pivotable relative to the outer carrier, and a cam and a cam profile adapted to be engaged with the cam on respective ones of the cam lever and inner carrier, and causing the cam lever to pivot relative to the outer carrier.

Still other aspects, features, and advantages of the present invention may be readily apparent from the following detailed description by illustrating a number of example embodiments and implementations, including the best mode contemplated for carrying out the present invention. The present invention may also be capable of other and different embodiments, and its several details may be modified in various respects, all without departing from the scope of the present invention. Accordingly, the drawings and descriptions are to be regarded as illustrative in nature, and not as restrictive. The invention is to cover all modifications, equivalents, and alternatives falling within the scope of the invention.

DESCRIPTION OF DRAWINGS

FIG. 2B illustrates a partially cross-sectioned side view of an electrical contact apparatus according to embodiments, with the front half of an outer carrier, inner carrier, and cam lever removed for clarity.

FIG. 2C illustrates a side view of an outer carrier according to embodiments.

FIG. 2D illustrates a side view of an inner carrier according to embodiments.

FIG. 2E illustrates a side view of a contact finger with coupled electrical conductors according to embodiments.

FIG. 2F illustrates a side view of a cam lever according to embodiments.

FIG. 2G illustrates an isometric view of an outer carrier according to embodiments.

FIG. 2H illustrates an isometric view of contact apparatus mounting bracket according to embodiments.

FIG. 2I illustrates an isometric view of an inner carrier according to embodiments.

FIG. 2J illustrates a partial, partially cross-sectioned side view of a cam according to embodiments.

FIG. 2K illustrates an isometric view of a cam lever according to embodiments.

FIGS. 7 and 8 illustrate isometric views of an electrical contact apparatus including a slot motor according to embodiments.

DESCRIPTION

Embodiments of the electrical contact apparatus and electrical contact assembly are useful in circuit breakers, such as in low voltage circuit breakers. Embodiments of the electrical contact apparatus are especially adapted for use in circuit breakers containing contact assemblies having multiple contact fingers that are intended to blow apart under very high short circuit conditions. It is desirable that such circuit breakers have electrical contacts that remain closed without popping under certain conditions. Such conditions may include high withstand currents, such as currents up to about 23 times the rated current of the circuit breaker. To accomplish this high withstand capability, relatively high spring forces may be provided to keep the moving and stationary electrical contacts from separating. However, space within the circuit breaker is generally very limited for the installation of relatively large springs and large structural components supporting such large springs. Existing designs have attempted to remedy this by the addition of larger springs and components. However, in these designs, either the withstand rating is compromised, or a large amount of space must be allotted for the larger springs making the circuit breaker physically larger.

In view of the foregoing difficulties, improved electrical contact apparatus and electrical contact assemblies are provided. According to one or more embodiments, an electrical contact apparatus is provided that includes an outer carrier, an inner carrier moveable relative to the outer carrier, one or more contact fingers pivotally mounted to the inner carrier, a cam lever pivotally mounted to the outer carrier, and including a cam. The cam and cam profile may be formed on respective ones of the cam lever and inner carrier. In operation, the cam being adapted to follow the cam profile. Electrical contact assemblies including the contact apparatus are described as are methods of operating the contact apparatus and assembly. As will become apparent, the electrical contact apparatus with the cam lever advantageously provides leverage (e.g., mechanical advantage) that allows the spring force requirements to be reduced and therefore allows the use of smaller contact springs.

These and other embodiments of the electrical contact apparatus, electrical contact assemblies, circuit breakers including the electrical contact apparatus and electrical contact assembly, and methods of operating the electrical contact apparatus and electrical contact assembles are described below with reference to FIGS. 1-13. The drawings are not necessarily drawn to scale. Like numerals are used throughout to denote like elements.

Figure 1:
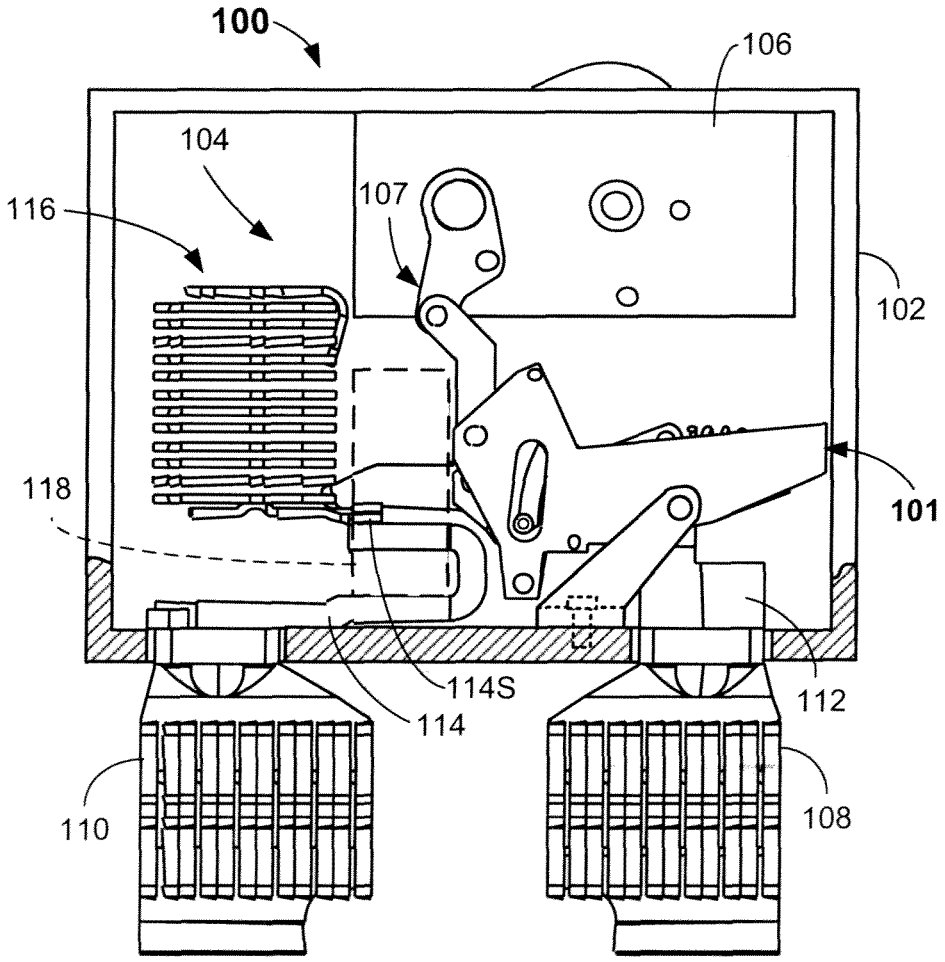
FIG. 1 illustrates a side view of a circuit breaker including an electrical contact assembly according to embodiments.

Referring now in specific detail to FIG. 1, a circuit breaker 100 is shown. The circuit breaker 100 may be a single pole or multi-pole circuit breaker having multiple electrical contact apparatus 101 installed in a circuit breaker housing 102. For example, the circuit breaker 100 may comprise multiple individual electrical contact apparatus 101, corresponding to three or more electrical phases with the circuit breaker 100 provided for each electrical phase. Four- or even five-phase circuit breakers may optionally be provided, with a single electrical contact apparatus 101 as described herein designated for each phase. For example, each electrical contact apparatus 101 can be oriented in a side-by side configuration within the housing 102 (See FIGS. 5 and 6).

The contact apparatus 101 may be included in an electrical contact assembly 104 installed in the circuit breaker housing 102 of a circuit breaker 100. The electrical contact assembly 104 may include an operating mechanism 106 that mechanically couples to the contact apparatus 101 by way of linkages 107 or the like to cause the contact apparatus 101 to open to an OFF configuration at certain times, such as in response to any tripping event or turning the circuit breaker 100 to an OFF configuration. The operating mechanism may be manually or electronically controlled, i.e., responsive to electronic control signals. A single operating mechanism 106 may be attached to one or more than one electrical contact apparatus 101, such as is shown in FIGS. 1, 2L, and 5-6. The operating mechanism 106 may be either a stored energy type mechanism, or a handle-operated toggle mechanism. With a stored energy mechanism, the main springs are charged via a ratcheting handle or optionally an electric motor. The main springs are capable of storing enough energy for 2 close-open operations, that is, close-open-close-open, without any intermediate charging of the springs. Opening and closing are initiated via push buttons or remote control, and during a fault condition the operating mechanism may be tripped automatically by a device, such as an electronic trip unit. A handle-operated toggle mechanism is a lower cost option that utilizes an over-center spring-toggle mechanism. Beginning with an initially discharged spring system, the handle is pushed to the OFF/RESET position to charge the springs and latch the mechanism. Then the handle is pushed to the ON position to close the contacts. From the ON position, the handle can be pushed to OFF to open the contacts, or else in the case of a fault condition, a sensing device such as a thermal/magnetic trip unit or an electronic trip unit will actuate tripping by rotating a latch lever. Existing examples of stored energy mechanisms included the Siemens 3WL line of air circuit breakers. Existing examples of handle-operated toggle mechanisms included the Siemens Sentron and 3VL lines of molded-case circuit breakers. The electrical contact apparatus 101 may be electrically coupled to electrical terminals, such as load terminal 108, and line terminal 110. Any suitable terminal type may be provided, such as plug-in type terminals.

The electrical contact apparatus 101 may electrically couple to load conductor 112 and line conductors 114 that are adapted to connect to the load terminal 108, and line terminal 110, respectively. The contact apparatus 101 may be electrically coupled to the load and line terminals 108, 110 by load conductor 112 and line conductor 114, respectively. Load conductor 112 and line conductor 114 may be manufactured from any suitably electrically conductive material, such as copper or a copper alloy. Any suitable configuration for the load conductor 112 and line conductor 114 may be used. For example, the line conductor 112 may include a bent over configuration with the stationary electrical contact 114S being coupled to the line conductor 114. The load conductor 112 may couple to flexible conductors which are, in turn coupled to the one or more contact fingers. An arc plate assembly 116 may be provided adjacent to the electrical contacts of the contact apparatus 101 to aid in arc extinguishment. Optionally, a slot motor 118 may be provided adjacent to the contacts. The slot motor 118 may be of any suitable construction.

Figure 2A:
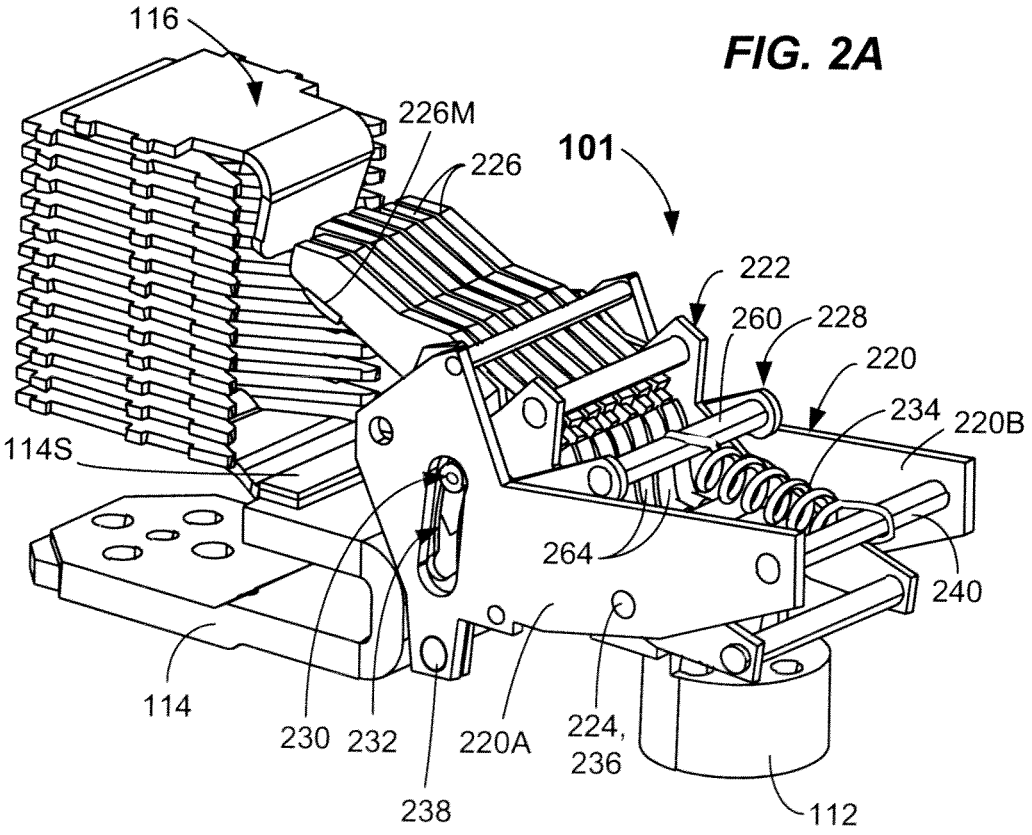
FIG. 2A illustrates an isometric view of an electrical contact apparatus according to embodiments.

Referring now in specific detail to FIG. 2A to FIG. 2I, an embodiment of the electrical contact apparatus 101 and its various components are shown in detail. The electrical contact apparatus 101 will be referred to herein as an "electrical contact apparatus," or "contact apparatus." The electrical contact apparatus 101 may be installed in any suitable orientation within a circuit breaker housing 102. As shown, the electrical contact apparatus 101 includes an outer carrier 220, an inner carrier 222 moveable relative to the outer carrier 220 about an inner carrier pivot 224, one or more contact fingers 226 pivotally mounted to the inner carrier 222, and a cam lever 228. The cam lever 228 may be pivotally mounted to the outer carrier 220. A cam 230 and cam profile 232 are formed on respective ones of the cam lever 228 and inner carrier 222. The cam 230 is adapted to follow along the cam profile 232 in operation, as will be described further herein. A cam spring 234 may be provided and may be coupled to cam lever 228 to provide spring bias to the cam lever 228. Cam spring 234 may be coupled to the outer carrier 220 at cam spring support 240. Other spring mounting locations and configurations may be used. FIG. 2A is shown in the blow-opened, but not reset configuration. Resetting is accomplished by raising the outer carrier 220.

In more detail, the various components of the electrical contact apparatus 101 will now be described. The outer carrier 220, as best shown in FIGS. 2A, 2C and 2G, may include a first leg 220A and a second leg 220B spaced from the first leg 220A, an outer carrier pivot 236, a cam lever pivot 238, and a cam spring support 240. The outer carrier pivot 236 may be coupled by a bracket 245 (FIG. 2H) or the like to the circuit breaker housing 102. Any suitable mounting configuration may be used. The outer carrier pivot 236 may be formed by any suitable means. For example, the outer carrier pivot 236 may be formed as a step shaft on the ends of the inner carrier pivot 224, which may extend from the outer carrier legs 220A, 220B and pivot in bracket holes 245A formed on arms of the bracket 245 received on either side of the outer carrier 220. The cam lever pivot 238 is spaced from the outer carrier pivot 236.

The outer carrier 220 may include attachment features 242, which can be used for attaching the linkages 107 such that the electrical contacts may be opened at times upon action of the operating mechanism 106 (e.g., upon tripping or actuation to the OFF configuration). The attachment features 242 may include stop rivets, screws, or other fasteners to allow pivotal attachment of the linkages 107. Linkages 107 should be non-conductive or otherwise insulated. The outer carrier 220 may include one or more cross supports 244 for providing structural rigidity. The bracket, 245, first leg 220A, second leg 220B, inner carrier pivot 224, outer carrier pivot 236, and cross supports 244 may be manufactured from a suitable rigid material, such as steel, stainless steel, or brass.

The inner carrier 222 may include a first side 222A and a second side 222B, and a contact spring support 248 coupled to one or more of the first and second sides 222A, 222B. In the depicted embodiment, the contact spring support 248 extends between the sides 222A, 222B. The first side 222A, second side 222B, and the contact spring support 248 may be made as an integral piece or welded to the sides 222A, 222B. The inner carrier 222 may include a contact finger over-travel stop 250 and a contact finger blow open stop 252 that functions to limit motion of the one or more contact fingers 226 within bounds. The contact finger over-travel stop 250 and a contact finger blow-open stop 252 may be bars extending between the sides 222A, 222B. A finger pivot pin 254 that may extend between the sides 222A, 222B is adapted to pivotally receive the one or more contact fingers 226. The finger pivot pin 254 may include pilots 254A, 254B (FIG. 2I) on either end that may be welded into holes in the sides, or otherwise fastened such as by riveting the pilots 254A, 254B. Contact finger over-travel stop 250 may be similarly fastened. The first side 222A, second side 222B, the contact spring support 248, contact finger over-travel stop 250, contact finger blow-open stop 252, and finger pivot pin 254 may be manufactured from a suitable rigid material, such as steel, stainless steel, or brass.

The inner carrier pivot 224 may be formed as a stepped pin where the end pilots 224A, 224B on either end may be received through the inner carrier sides 222A, 222B and extend beyond the sides to form a pilot that is received into receiving holes in the outer carrier legs 220A, 220B of the outer carrier 220 to form the outer carrier pivot 236. The inner carrier pivot 224 and outer carrier pivot 236 are shown as being coincident and co-located in the depicted embodiment, i.e., the inner carrier pivot and the outer carrier pivot comprise a common pivot axis. In this embodiment, the bracket 245 may be connected to the extending pilots 224A, 224B of the inner carrier pivot 224 extending through each of the inner carrier sides 222A, 222B and the outer carrier legs 220A, 220B. The ends of the extending pilots 224A, 224B may be riveted or threaded to receive a fastener to pivotally fasten the outer carrier 220 to the bracket 245. Optionally, the inner carrier pivot 224 and outer carrier pivots 236 may be offset from one another. The inner carrier 222 may include an optional extension 222C that may be adapted to mount an extra return spring (See FIG. 12).

In the depicted embodiment, the cam 230 is provided on one or both sides of the inner carrier 222. The cam profile 232 may be provided on one or both sides of the cam lever 228. To prevent binding, the cam 230 should be provided on both sides. The cam 230 may be formed by any suitable structure. As depicted in FIG. 2J, the cam 230 is a roller cam including an outer roller 230A that may freely rotate about roller shaft 230B, as shown in cross section. The cam roller 230A rides on one or more suitably formed cam profiles 232 on the cam lever 228. The cam roller shaft 230B may be formed as a step on the contact finger over travel stop 252, for example. Optionally, the cam 230 may be formed elsewhere on the inner carrier 222. The cam 230 and cam profile 232 may be formed in any location offering sufficient leverage. In another configuration, the cam 230 may be formed on the cam lever 228 and the cam profile 232 may be formed on a surface of the inner carrier 222. Thus, the cam 230 and cam profile 232 may be formed on respective ones of the cam lever 228 and inner carrier 222, wherein the cam 230 is adapted to follow the cam profile 232.

The cam lever 222, as best shown in FIG. 2K may include first side 228A located proximate to a first side 222A of the inner carrier 222, and second side 228B located proximate to a second side 222B of the inner carrier 222. The sides 228A, 228B may be attached by cam lever pivot bar 255 having pilots 255A, 255B that may extend through sides 228A, 228B. The pilots 255A, 255B may be pivotally received in holes 256 in the outer carrier 220 to form the cam pivot 238. Other types of pivot-forming mechanisms may be employed. The cam lever 228 may include a lever arm 258 and may include a spring mount 260 extending between and coupling the sides 228A, 228B. The spring mount 260 may be a step pin including pilots received and fastened in the sides 228A, 228B, as previously described. The cam profile 232 may be included on a sidewall of a cutout portion 262 that may be a slot or groove formed in one or both of the sides 228A, 228B. The cam profile 232 may include an arced surface, for example. Other arc radiuses may be used. The cam lever 228 is configured and adapted to pivot about the cam pivot 238 and the cam 230 rides on the cam profile 232, while the cam spring 234 may mount between the contact spring support 240 on the outer carrier 220 and the spring mount 260 on the cam lever 228. The desired relative dimensions of the cam lever 228 will be described further herein. The cam lever 222 may be manufactured from a suitable rigid material, such as steel, stainless steel, or brass.

Now referring to FIG. 2E, the one or more contact fingers 226 may be electrically coupled to a respective load terminal 108 (e.g., a single phase) by one or more flexible electrical conductors 264. In some embodiments, the flexible conductor 264 may be one or more braided or laminated conductive metal lines, such as braided copper. At least one flexible conductor 264 may be connected to each of the contact fingers 226, such as by braising, welding, soldering, mechanical fastening, or the like. Other means for connection may be employed, such as securing the flexible conductors 264 to connector elements 264A, 264B that are then connected to the respective contact fingers 226 and load terminal 108, by any of the connection methods described above. Each electrical contact apparatus 101 may include one or more contact fingers 226. The one or more contact fingers 226 may include an aperture 226A that is received over the contact finger pivot pin 254 such that each contact finger 226 may freely pivot thereon. A moving electrical contact 226M may be formed on the end of each of the contact fingers 226 and may electrically couple with the stationary contact 114S in the closed configuration (FIG. 1). Each contact finger 226 may include a spring mounting tab 226S configured and adapted to mount the contact spring 265 between each contact finger 226 and the contact spring support 248 (FIG. 2B).

In the depicted embodiment, the each contact spring 265 may be a helical coil spring. The spring 265 is sized to provide a spring force FS effective at the main contacts 226M, for example. Other levels of spring force may be used. The contact spring 265 may have any suitable length and shape. The cam spring 234 may be a single helical coil spring, or multiple springs in parallel. From FIG. 3 it is clear that if there are N fingers with contact force FS each, then the total moment about the common pivot 224 will be [N*FS*(D1+D2)]. This moment s opposed by an equal resisting moment in the opposite direction, which is supplied by the cam spring 234. The resisting moment is (F1×D7), where F1 is supplied by the cam spring force and is equal to (F2*D6/D5). Therefore, the cam spring 234 must supply a force F2 greater than or equal to [N*FS*D5*(D1+D3)/(D6*D7). By supply such a force from the cam spring, this assures that the electrical contacts remain closed, and that the cam spring 234 is able to resist the contact springs 265.

In some embodiments, the use of the cam lever 228 and cam spring 234 may improve the withstand rating (maximum short time current the circuit breaker can withstand without opening the electrical contacts) of the circuit breaker 100. The ratio D5/D6 represents a mechanical advantage that is advantageous, because it multiplies the total moment that the cam spring 234 may effectively supply to the one or more contact fingers 226. To the extent practical, the dimension D7 shall be made as large as possible to maximize the effective moment delivered from the cam spring 234. Therefore, a relatively greater holding moment is supplied to the one or more contact fingers 226, than other concepts which do not have a mechanical advantage. The contact force between the stationary contact 114S and the moving contact 226M should be between about 30N and 50 N, for example. Other contact forces may be used.

Figure 2L:
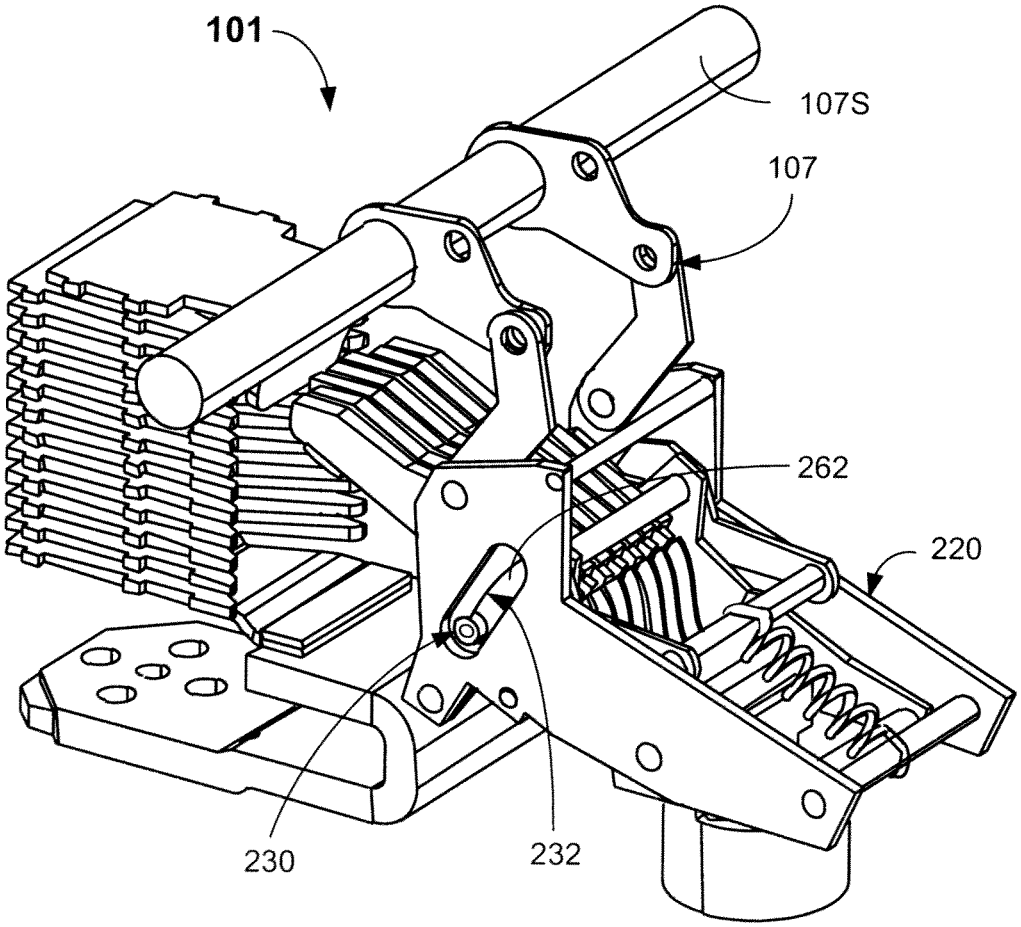
FIG. 2L illustrates an isometric view of a contact apparatus in an OFF configuration according to embodiments.

FIG. 2L illustrates the contact apparatus 101 shown in a opened configuration with the cam 230 being reset back to the lower position on the cam profile 232, and with the outer carrier 220 lifted into the OFF configuration by the linkages 107 through rotation of shaft 107S. During a short circuit, the outer carrier 220 will remain in the closed orientation until opened by the operating mechanism 106. This opening may take place a short delay after the trip. In this reset configuration, the cam 230 is located at a bottom extent of the cutout portion 262. At this location, the cam 230 may rest in a detent 263 that serves to provide a surface anomaly that prevents blow open unless a finite level of blow open force is achieved.

Figure 3:
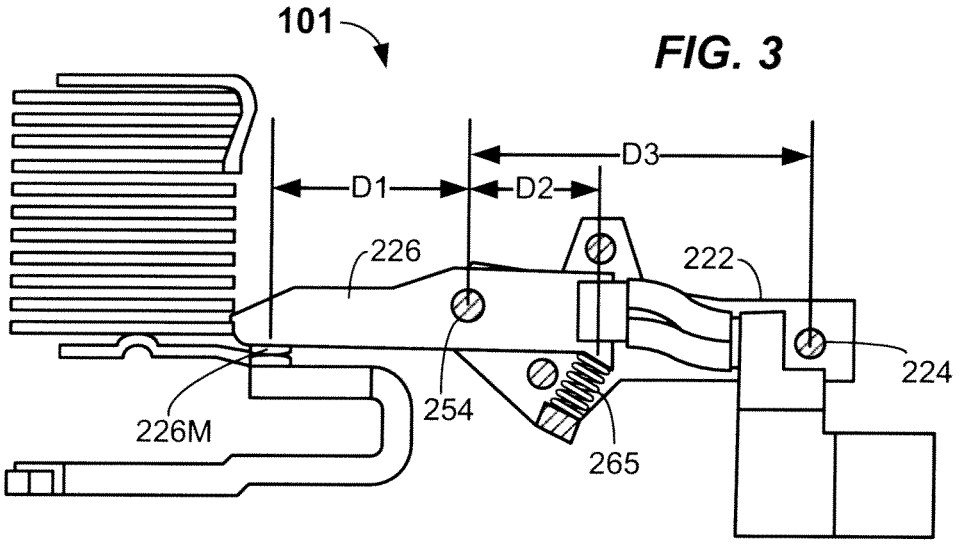
FIG. 3 illustrates a side view of an electrical contact apparatus and some components thereof according to embodiments, with the outer carrier, cam lever and a side of the inner carrier being removed for clarity.
Figure 4:
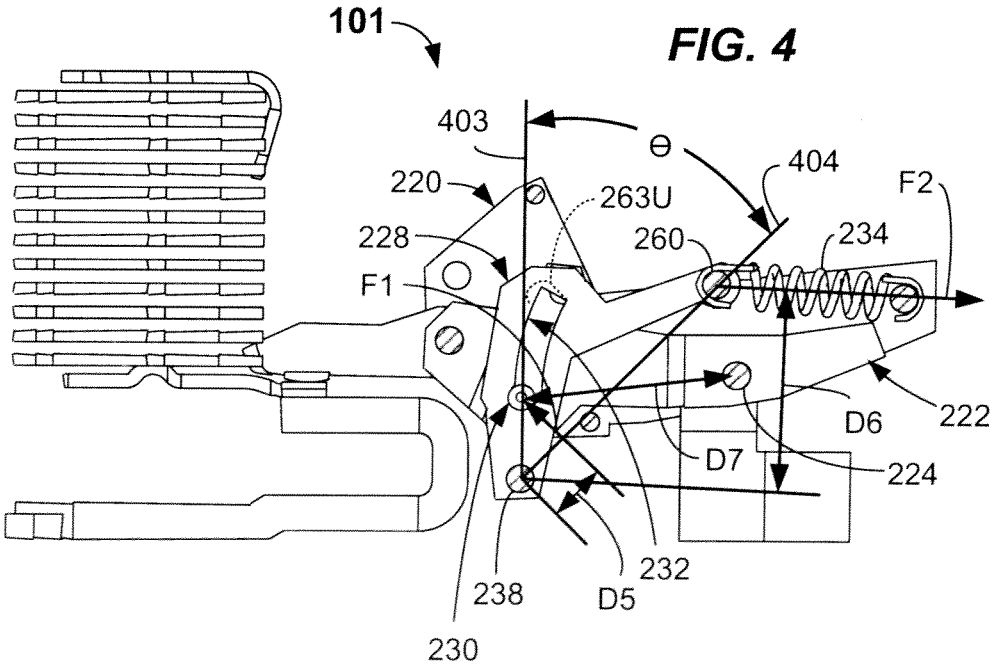
FIG. 4 illustrates a side view of an electrical contact apparatus according to embodiments, with a side of the outer carrier being removed for clarity.

Now referring to FIGS. 3 and 4, portions of the contact apparatus 101 are shown in a closed configuration for illustration purposes. FIG. 3 illustrates the relative distance D1 between the moving contact 226M and the contact finger pivot 254, the relative distance D2 between the contact finger pivot 254 and the mounting location of the contact spring 265, and the relative distance D3 between the contact finger pivot 254 and the inner carrier pivot 224 of the inner carrier 222. The distance D1 may be between about 25 and about 35 mm. The distance D2 may be between about 20 and about 30 mm. The distance D3 may be between about 80 and about 100 mm. A relative increase in a D2/D1 ratio may increase the contact blow-on force, and also may increase a reaction force at the finger pivot 254. A relative ratio of D3/D1 may be between about 2.5 and about 3.0. Other distances and ratios may be used.

FIG. 4 illustrates a side view of the contact apparatus 101 with a front leg of the outer carrier 220 removed for viewing clarity. A relative distance D5 between the locations of the cam pivot 238 and a force vector F1 acting on the cam profile 232, as well as the relative distance D6 between the cam pivot 238 and a force vector F2 acting on the cam spring mount 260, when in the closed configuration shown. The distance D5 may be between about 10 and about 15 mm. The distance D6 may be between about 40 and about 50 mm. The ratio of D6/D5 may be greater than about 2:1, greater than about 3:1, or even greater than about 5:1 in some embodiments. The mechanical advantage achieved is defined by Eqn. 1:

$$F1=(D5/D6)F2 \qquad \text{Eqn. 1}$$

In the closed configuration, an angular orientation θ between a line 403 connecting the centers of the cam pivot 238 and the cam 230, and a line 404 connecting the centers of the cam pivot 238 and the cam spring mount 260 may be between about 40 degrees and about 50 degrees. Other distances, ratios, and angular orientations may be used.

FIG. 4 also illustrates that an upper detent 263U (shown dotted) may be optionally provided on the cam lever 228 in a similar manner as the detent 263 provided on the bottom. This provides a lock-open function which catches the inner carrier 222 and holds the inner carrier 222 in a blown-open configuration. The upper detent 263U also prevents the inner carrier 222 from reclosing until reset by the operating mechanism 106.

Figure 5:
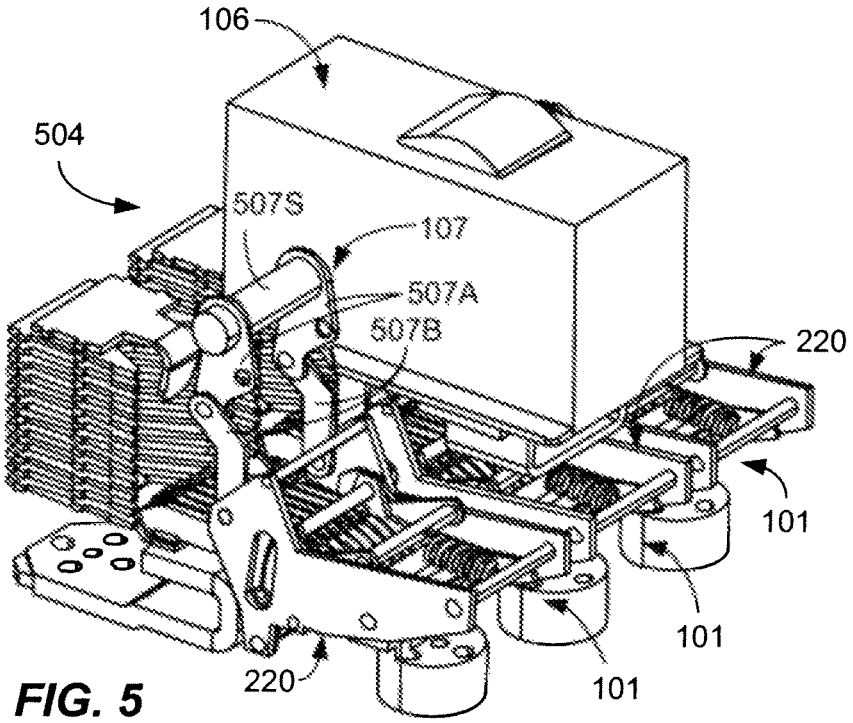
FIG. 5 illustrates an isometric view of a multiphase electrical contact assembly according to embodiments.
Figure 6:
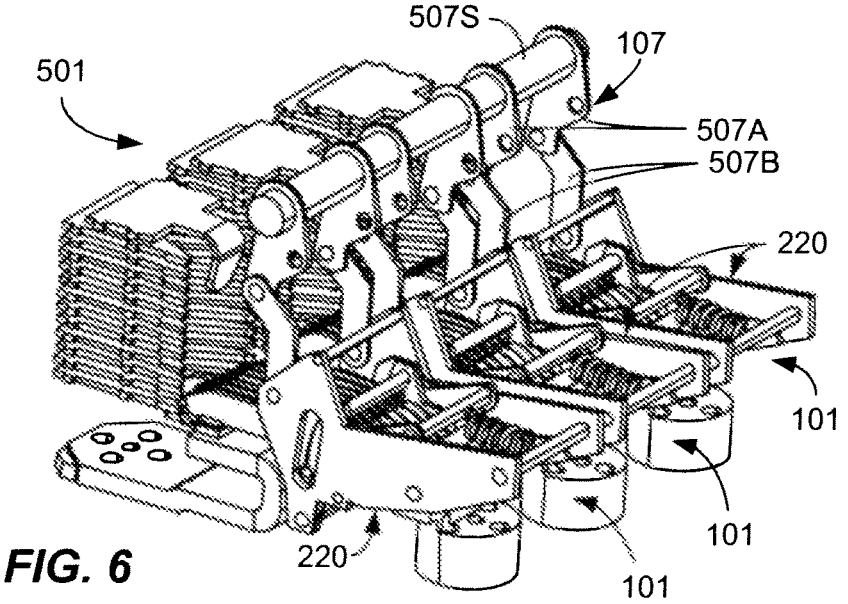
FIG. 6 illustrates an isometric view of a multiphase electrical contact apparatus according to embodiments.

As shown in FIGS. 5 and 6, individual contact apparatus 101 may be assembled into a multi-pole contact apparatus 501 (FIG. 6) and a multi-pole contact assembly 504 (FIG. 5). In the depicted embodiment, the individual contact apparatus 101 may be identical to one another and constructed as has been described herein. Each contact apparatus 101 may be configured and adapted to receive a single electrical phase provided from a polyphase electrical power distribution system (not shown). The multi-pole contact assembly 504 has three phases. However, various embodiments are equally adapted for use with four-phase systems, five-phase systems, or the like. Other numbers of phases may be used. Each of the individual contact apparatus 101 may be pivotally mounted to the circuit breaker housing 102 (FIGS. 1, and 2B) by a bracket 245 (FIG. 2H). Actuation of the operating mechanism 106 rotates a shaft 507S coupled to the linkages 107 and rotates links 507A that are fixed to the shaft, which effectively pulls up on links 507B coupled to the outer carrier 220 of each contact apparatus in unison.

In operation, when a tripping event occurs, such as due to a current over the rated current of the phase, rotation of the one or more moveable contact fingers 226 occurs. This causes the one or more contact fingers 226 to rapidly rotate and move from a closed (ON) configuration (FIG. 1) to a blown open configuration (FIG. 2A). As the contact fingers 226 open, the inner carrier 222 is rotated, and the cam lever 228 is actuated. This causes the cam 230 to ride along the cam profile 232 and move from a lower position along the cam profile (FIG. 1), such as a location in the detent 263, to an upper position along the profile 232 (FIG. 2A). The cam profile 232 generally includes a non-straight shape (e.g., arced) and may have an arc radius R of about 50 mm to about 55 mm, as shown in FIG. 2F. Other radius values may be used. In one or more embodiments, this radius R will be exactly centered on the common pivot axis 224, when the contact apparatus 901 is in the blown-open position as shown in FIG. 12.

Now referring to FIGS. 7 and 8, a contact apparatus 701 is shown that includes a slot motor 705. In the depicted embodiment, a three-finger contact apparatus 701 is illustrated with the slot motor 705 installed alongside outer ones of the contact fingers 726 side of the contact finger assembly and underneath the contact fingers 726. The outer carrier and cam lever have been removed for clarity. The slot motor 705 may be of conventional construction.

Figure 9:
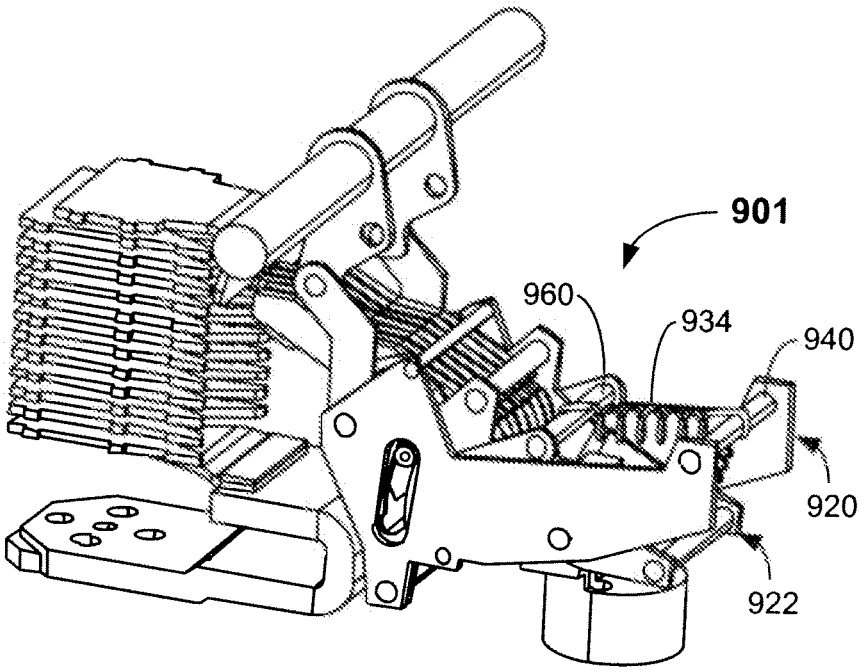
FIG. 9 illustrates an isometric view of an electrical contact apparatus in a blown open configuration according to embodiments.
Figure 10:
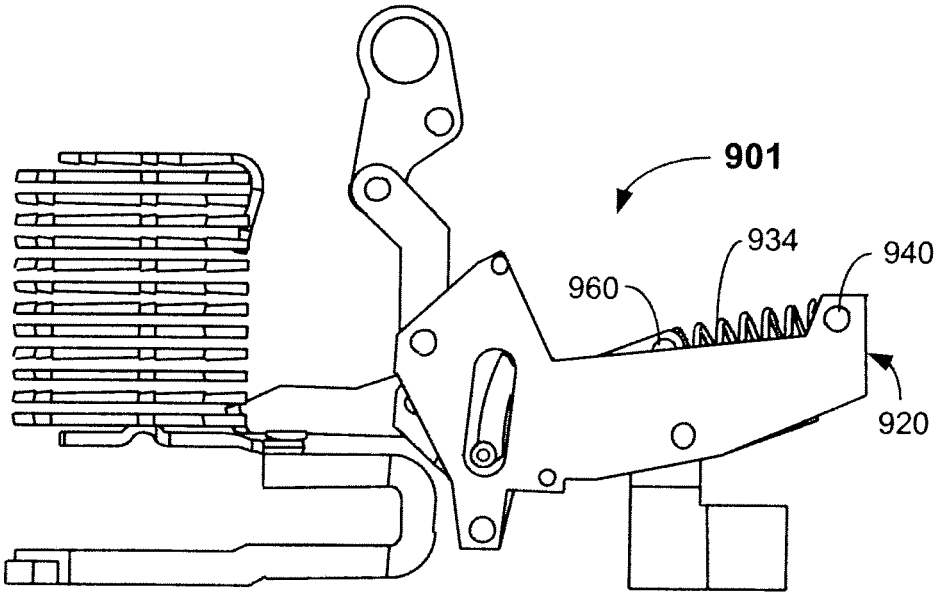
FIG. 10 illustrates a side view of an electrical contact apparatus in an ON configuration according to embodiments.
Figure 11:
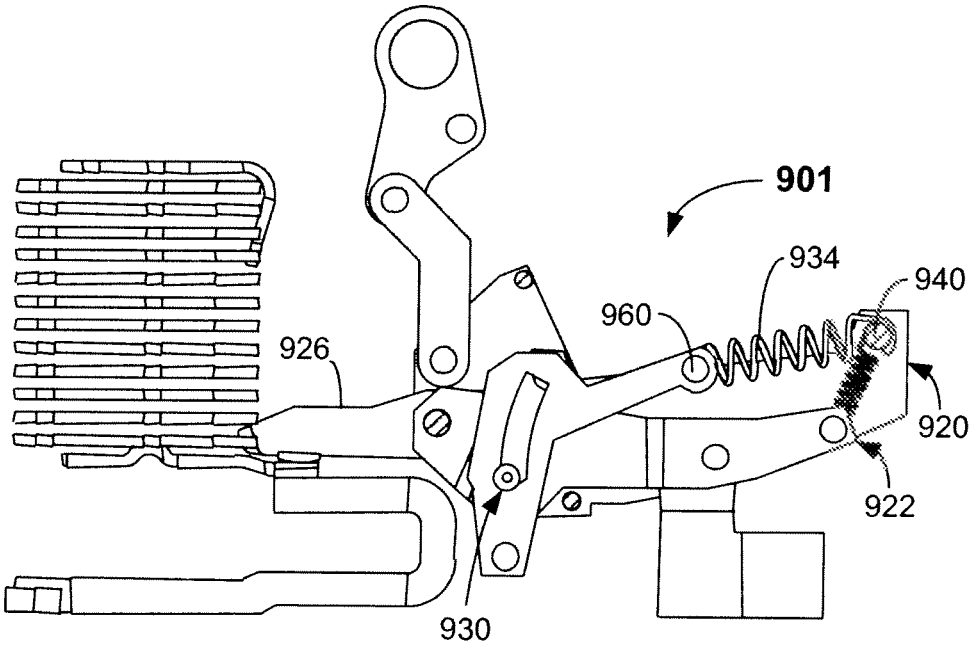
FIG. 11 illustrates a side view of various components of an electrical contact apparatus shown in an ON configuration according to embodiments, with a side of the outer carrier removed for clarity.
Figure 12:
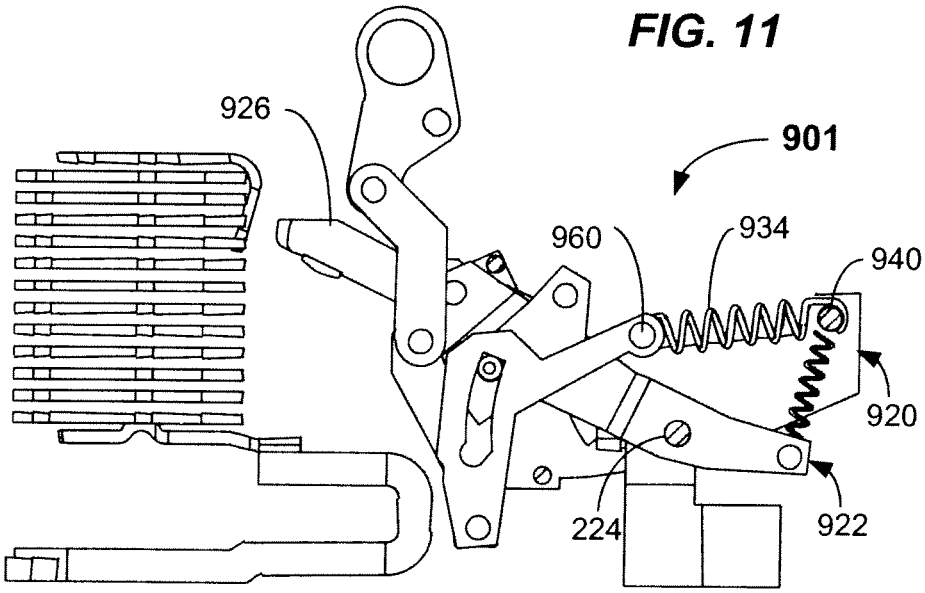
FIG. 12 illustrates a side view of various components of an electrical contact apparatus shown in a blown open configuration according to embodiments.

As shown in FIGS. 9 and 12, an alternate configuration of a contact apparatus 901 is shown. In the contact apparatus 901, the cam spring support 940 of the outer carrier 920 is raised such that in both a blown-open and a closed (ON) configuration, such as shown in FIGS. 10 and 12 and FIGS. 9 and 11, respectively, the cam spring 934 is inclined with an outer end coupled to the spring support 940 being located higher than an inner end coupled to the cam spring mount 960. Furthermore, a return spring 965 may be attached between the outer carrier 920 and the inner carrier 922. The return spring 965 functions to reclose the inner carrier 922 after blow open due to short circuit magnetic forces. FIGS. 11 and 12 also illustrate that the cam 930 moves along the cam profile 932 as the contact fingers 926 are blown open.

Figure 13:
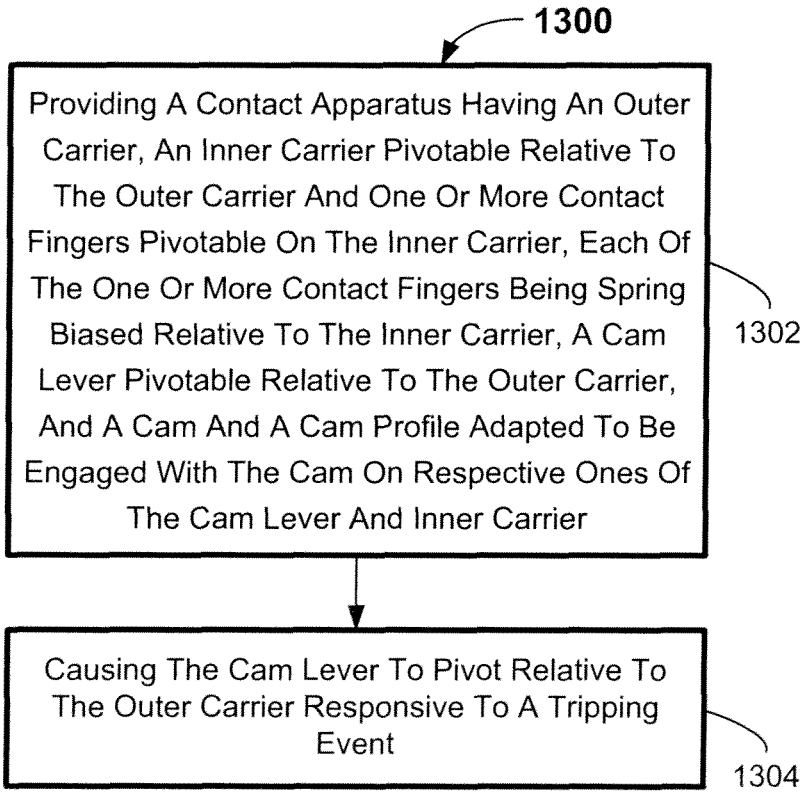
FIG. 13 is a flowchart illustrating a method of operating an electrical contact assembly according to embodiments.

FIG. 13 is a flowchart illustrating a method of operating an electrical contact assembly (e.g., 104) according to embodiments. The method 1300 includes, in 1302, providing a contact apparatus (e.g., 101) having an outer carrier (e.g., 220), an inner carrier (e.g., 222) pivotable relative to the outer carrier and one or more contact fingers (e.g., 226) pivotable on the inner carrier, each of the one or more contact fingers being spring biased relative to the inner carrier, a cam lever (e.g., 228) pivotable relative to the outer carrier, and a cam (e.g., 230) and a cam profile (e.g., 232) adapted to be engaged with the cam on respective ones of the cam lever and inner carrier, and, in 1304, causing the cam lever to pivot relative to the outer carrier responsive to a tripping event. The tripping event may be a trip of the contact apparatus to a blown-off configuration due to experiencing an over current situation or the like. Another tripping event is opening the contact apparatus (e.g., 101) by actuating the operating mechanism 106 thereby rotating the outer carrier and breaking the electrical contacts (e.g., 116S, 226M).

While the invention is susceptible to various modifications and alternative forms, specific embodiments and methods thereof have been shown by way of example in the drawings and are described in detail herein. It should be understood, however, that it is not intended to limit the invention to the particular apparatus, systems, or methods disclosed, but, to the contrary, the intention is to cover all modifications, equivalents and alternatives falling within the spirit and scope of the invention.

What is claimed is:

1. An electrical contact apparatus, comprising:

an outer carrier;

an inner carrier moveable relative to the outer carrier about an inner carrier pivot;

one or more contact fingers pivotally mounted to the inner carrier;

a cam lever pivotally mounted to the outer carrier; and a cam formed on the inner carrier and a cam profile formed on the cam lever, the cam being adapted to follow the cam profile.

2. The electrical contact apparatus of claim 1, comprising a cam spring coupled between the cam lever and the outer carrier.

3. The electrical contact apparatus of claim 1, wherein the cam comprises a cam roller.

4. The electrical contact apparatus of claim 1, wherein the cam lever comprises:

a first lever side located proximate to a first side of the inner carrier, and a second lever side located proximate to a second side of the inner carrier.

5. The electrical contact apparatus of claim 1, wherein the inner carrier comprises a first side and a second side, and a contact spring support coupled to one or more of the first and second sides.

6. The electrical contact apparatus of claim 5, wherein the inner carrier comprises a contact finger over-travel stop and a contact finger blow-open stop.

7. The electrical contact apparatus of claim 1, wherein the inner carrier pivot and the outer carrier pivot comprise a common pivot axis.

8. The electrical contact apparatus of claim 7, wherein the first lever side and the second lever side are interconnected by a cam spring mount.

9. The electrical contact apparatus of claim 1, wherein the cam profile is provided in a slot.

10. The electrical contact apparatus of claim 9, wherein the slot comprises a detent.

11. The electrical contact apparatus of claim 1, wherein the outer carrier comprises a left leg, a right leg, and an outer carrier pivot.

12. The electrical contact apparatus of claim 11, wherein the outer carrier comprises a cam spring support.

13. The electrical contact apparatus of claim 11, wherein the outer carrier comprises a cam lever pivot spaced from the outer carrier pivot.

14. An electrical contact assembly, comprising:

a contact apparatus having an outer carrier, an inner carrier having one or more contact fingers adapted to rotate relative to the inner carrier, each of the one or more contact fingers being spring biased relative to the inner carrier, the inner carrier being pivotable relative to the outer carrier, a cam lever pivotable relative to the outer carrier, a cam and a cam profile adapted to be engaged with the cam, the cam formed on the inner carrier and the cam profile formed on the cam lever; and an operating mechanism coupled to the outer carrier and adapted to open and/or close the contact apparatus.

15. The electrical contact assembly of claim 14, comprising:

a first linkage coupled to a drive shaft of a drive motor, and a second linkage coupled to the outer carrier.

16. A contact apparatus, comprising:

an outer carrier having a first leg and a second leg spaced from the first leg, an outer carrier pivot, a cam lever pivot, and a cam spring mount;

an inner carrier having a first side and a second side spaced from the first side, a contact spring support extending between the first and second side, and cams mounted to each of the first side and the second side, the inner carrier being adapted to pivot about an inner carrier pivot relative to the outer carrier wherein the inner carrier pivot and the outer carrier pivot are co-axial;

one or more contact fingers pivotally mounted to a finger pivot pin extending between the first side and second side of the inner carrier;

a contact spring biasing each contact finger relative to the contact spring support;

a cam lever having a first lever side, and a second lever side, and a cam profile on each of the first cam side and the second cam side that are adapted to be engaged by the cams, the cam lever adapted to pivot relative to the outer carrier on the cam lever pivot; and a cam spring coupled between the cam lever and the cam spring mount.

17. A circuit breaker, comprising:

a circuit breaker housing; and an electrical contact assembly mounted in the circuit breaker housing, the electrical contact assembly including a contact apparatus having an outer carrier, an inner carrier having one or more contact fingers adapted to rotate relative to the inner carrier, each of the one or more contact fingers being spring biased relative to the inner carrier, the inner carrier being pivotable relative to the outer carrier, a cam lever pivotable relative to the outer carrier, and a cam and a cam profile adapted to be engaged with the cam, the cam formed on the inner carrier and the cam profile formed on the cam lever; and an operating mechanism coupled to the outer carrier and adapted to open and/or close the contact apparatus.

18. A method of operating an electrical contact apparatus, comprising:

providing a contact apparatus having an outer carrier, an inner carrier pivotable relative to the outer carrier and one or more contact fingers pivotable on the inner carrier, each of the one or more contact fingers being spring biased relative to the inner carrier, a cam lever pivotable relative to the outer carrier, and a cam and a cam profile adapted to be engaged with the cam, the cam formed on the inner carrier and the cam profile formed on the cam lever; and causing the cam lever to pivot relative to the outer carrier responsive to a tripping event.

* * * * *